US011266212B2

(12) United States Patent
Jin

(10) Patent No.: US 11,266,212 B2
(45) Date of Patent: Mar. 8, 2022

(54) CONVENIENTLY OPEN AND CLOSE SUN UMBRELLA

(71) Applicant: FREESTYLE OUTDOOR LIVING CO., LTD, Ningbo (CN)

(72) Inventor: Ji Jin, Ningbo (CN)

(73) Assignee: FREESTYLE OUTDOOR LIVING CO., LTD., Ningbo (CN)

( * ) Notice: Subject to any disclaimer, the term of this patent is extended or adjusted under 35 U.S.C. 154(b) by 19 days.

(21) Appl. No.: 17/038,972

(22) Filed: Sep. 30, 2020

(65) Prior Publication Data

US 2021/0161262 A1 Jun. 3, 2021

(51) Int. Cl.
*A45B 25/14* (2006.01)
*A45B 23/00* (2006.01)

(52) U.S. Cl.
CPC ..... *A45B 25/14* (2013.01); *A45B 23/00* (2013.01); *A45B 2023/0012* (2013.01); *A45B 2023/0037* (2013.01); *A45B 2023/0081* (2013.01)

(58) Field of Classification Search
CPC . A45B 25/14; A45B 23/00; A45B 2023/0081; A45B 2023/0037
See application file for complete search history.

(56) References Cited

U.S. PATENT DOCUMENTS

| | | | | |
|---|---|---|---|---|
| 5,116,258 | A * | 5/1992 | Vennik | A45B 23/00 135/20.3 |
| 5,960,806 | A * | 10/1999 | Steiner | A45B 23/00 135/20.1 |
| 7,156,114 | B2 * | 1/2007 | Lo | A45B 23/00 135/20.1 |
| 8,104,492 | B2 * | 1/2012 | Dan | A45B 23/00 135/20.3 |
| 10,136,709 | B2 * | 11/2018 | Ma | A45B 23/00 |
| 10,932,536 | B2 * | 3/2021 | Kong | A45B 17/00 |
| 2010/0212705 | A1 * | 8/2010 | Tung | A45B 23/00 135/20.1 |

* cited by examiner

*Primary Examiner* — Noah Chandler Hawk
(74) *Attorney, Agent, or Firm* — Charles C. Achkar; Ostrolenk Faber LLP.

(57) ABSTRACT

The present invention provides a conveniently open and close sun umbrella, which includes a vertical pole, a connecting rod, an inclined rod, an umbrella frame and an umbrella opening mechanism. The two ends of the connecting rod are respectively hinged on the vertical pole and the inclined rod. The umbrella opening mechanism includes a first pull rope, a movable pulley, a second pull rope and a slide locking piece which is slidably mounted on the vertical pole. One end of the inclined rod is hinged on the slide locking piece, and the other end is hinged on a fixed umbrella disk. One end of the first pull rope is fixed on the movable pulley, and the other end is fixed on the movable umbrella disk. One end of the second pull rope is fixed on the vertical pole, and the other end is fixed on the slide locking piece.

10 Claims, 6 Drawing Sheets

CONVENIENTLY OPEN AND CLOSE SUN UMBRELLA

CROSS REFERENCE TO RELATED APPLICATIONS

The present application claims priority to China Application No. 201922098036.9 filed on Nov. 29, 2019, the subject matter of which is incorporated herein by reference in its entirety.

TECHNICAL FIELD

The present invention relates to the field of umbrellas, in particular to a conveniently open and close sun umbrella.

BACKGROUND ART

With the improvement in living standards, people engage more frequently in outdoor leisure activities. Sun umbrellas have become a common tool in leisure places such as squares, lawns, and beaches, providing users with a comfortable space to cool off. At present, sun umbrellas include straight-supported type and inclined-suspended type. The structure and principle of the straight-supported sun umbrellas are similar to ordinary umbrellas. They comprise mainly a vertical pole, a fixed umbrella disk fixed on top of the vertical pole, a movable umbrella disk set outside the middle of the vertical pole, a plurality of supporting ribs, a plurality of umbrella ribs and the canopy set on the umbrella ribs. When opening the umbrella, the movable umbrella disk is directly pushed and locked on the vertical pole and prop up the umbrella. As sun umbrellas are relatively large and heavy, the open and close operations are difficult, and usually many people are involved. Thus, practicability is low. The inclined-suspended type sun umbrellas generally comprise a vertical pole, an umbrella body, and pull rope. One end of the pull rope is connected to the movable umbrella disk, and the other end is directly connected with the pulling mechanism. Due to the large area of the umbrella body, it takes a lot of effort to complete the full opening or folding operation, and the opening and closing takes a lot of effort and time, it is very inconvenient to use.

SUMMARY OF THE INVENTION

(1) Technical Problems to be Solved

The problem to be solved by the present invention is to provide a sun umbrella which is convenient to open and close, so as to overcome the inconvenience of the existing sunshades.

(2) Technical Scheme

To solve the technical problem, the present invention provides a conveniently open and close sun umbrella, which comprises a vertical pole, a connecting rod, an inclined rod, an umbrella frame and an umbrella opening mechanism, whereby two ends of the connecting rod are respectively hinged on the vertical pole and the inclined rod; the umbrella opening mechanism includes a first pull rope, a movable pulley, a second pull rope and a slide locking piece, wherein the slide locking piece is slidably mounted on the vertical pole, the umbrella frame includes a central rod, a movable umbrella disk and a fixed umbrella disk fixed to the central rod; one end of the inclined rod is hinged on the slide locking piece, and the other end is hinged on the fixed umbrella disk; one end of the first pull rope is fixed on the movable pulley, and the other end passes through the connecting rod, the inclined rod and the central rod successively and is fixed on the movable umbrella disk; one end of the second pull rope is fixed on the vertical pole, and the other end goes around the movable pulley and is fixed on the slide locking piece; Through the cooperation of the first pull rope, the movable pulley, the second pull rope and the slide locking piece, the umbrella frame can be opened by sliding the slide locking piece upward. The operation process is simple and convenient, and the provided movable pulley can reduce the pulling force by half. It is labor-saving when opening, and conveniently open and close, with good practicability. To open, slides the slide locking piece upward, which drives the movable pulley to slide down, causes the movable umbrella disk to abut against the lower end of the central rod, thereby opens the umbrella frame.

Further, the umbrella frame also includes multiple ribs and multiple bracing ribs, wherein the end of each rib is hinged on the fixed umbrella disk; one end of each bracing rib corresponding to the inclined rod can be slidably mounted on the inclined rod, and the other end is hinged on the movable umbrella disk; both ends of the remaining bracing ribs are respectively hinged on the middle of the corresponding ribs and the movable umbrella disk.

Further, the central rod, the inclined rod, the connecting rod and the vertical pole are respectively rotatably installed with one or more first pulleys to facilitate pulling of the first pull rope; and the lower end of the vertical pole is rotatably installed with a second pulley to facilitate pulling of the second pull rope. The provision of a first pulley and a second pulley is beneficial to reduce the friction force of pulling the first pull rope and the second pull rope, so that the umbrella is more labor-saving and easier to open. A base is fixed at the bottom of the vertical pole, and the base is placed on the ground. The provided base can increase the contact area between the sun umbrella and the ground, and the sum umbrella becomes more stable. One end of the connecting rod is hinged to the upper end of the vertical pole, and the other end is hinged to the middle of the inclined rod. The slide locking piece is provided with a handle for convenience in sliding the slide locking piece. The handle is provided to facilitate sliding of the slide locking piece, for easier operation.

Further, the slide locking piece includes a locking mechanism and a sliding seat, wherein the sliding seat and the locking mechanism are respectively slidably mounted on the vertical pole. The locking mechanism includes a locking seat and a first locking rod hinged on the locking base. The end of the second pull rope is fixed on the locking base, and the locking base is snap fastened on the sliding seat by a limit chuck. One end of the first locking rod is provided with a first locking head, and a first locking groove matching with the first locking head is provided on the vertical pole. The slide locking piece further includes a second locking rod, wherein the second locking rod is hinged on the sliding seat. One end of the second locking rod is provided with a second locking head, and a plurality of second locking grooves matching with the second locking head are provided at equal intervals along a vertical direction on the vertical pole. The sliding seat is slidably installed with a first press block at a position corresponding to the first locking rod, and slidably installed with a second press block at a position corresponding to the second locking rod. The first locking rod and the second locking rod are having the same structure. A locking mechanism and a second locking rod are arranged in the slide locking piece. When the locking mechanism is locked, the second pull rope is fixed on the vertical pole, the umbrella frame is fully extended, and the sliding seat can be slid down by pressing the second locking rod, thereby causing the sliding seat to drive the inclined rod and change the angle of the umbrella frame, and the angle of the umbrella can be adjusted according to actual use requirements, making the application more flexible.

(3) Beneficial Effect

The present invention provides a conveniently open and close sun umbrella. Through the cooperation of the first pull rope, the movable pulley, the second pull rope and the slide locking piece, the umbrella frame can be opened by sliding the slide locking piece upward during application, causing the second pull rope to drive the movable pulley sliding down, and the first pull rope drives the movable umbrella disk to abut against the lower end of the central rod, thereby propping up the umbrella frame. The operation process is simple and convenient, and the opening and closing is convenient. In addition, the first pull rope is switched to the second pull rope through the movable pulley. The pulling force is reduced by half, which saves effort to open, and has good practicability. Moreover, a locking mechanism and a second locking rod are arranged in the slide locking piece. When the locking mechanism is locked, the second pull rope is fixed on the vertical pole, the umbrella frame is fully extended, and the sliding seat can be slid down by pressing the second locking rod, thereby causing the sliding seat to drive the inclined rod and change the angle of the umbrella frame, and the angle of the umbrella can be adjusted according to actual use requirements, making the application more flexible. It overcomes the shortcoming of inconvenience in opening and closing of the existing sunshades.

DESCRIPTION OF ACCOMPANIED FIGURE

Figure 1:
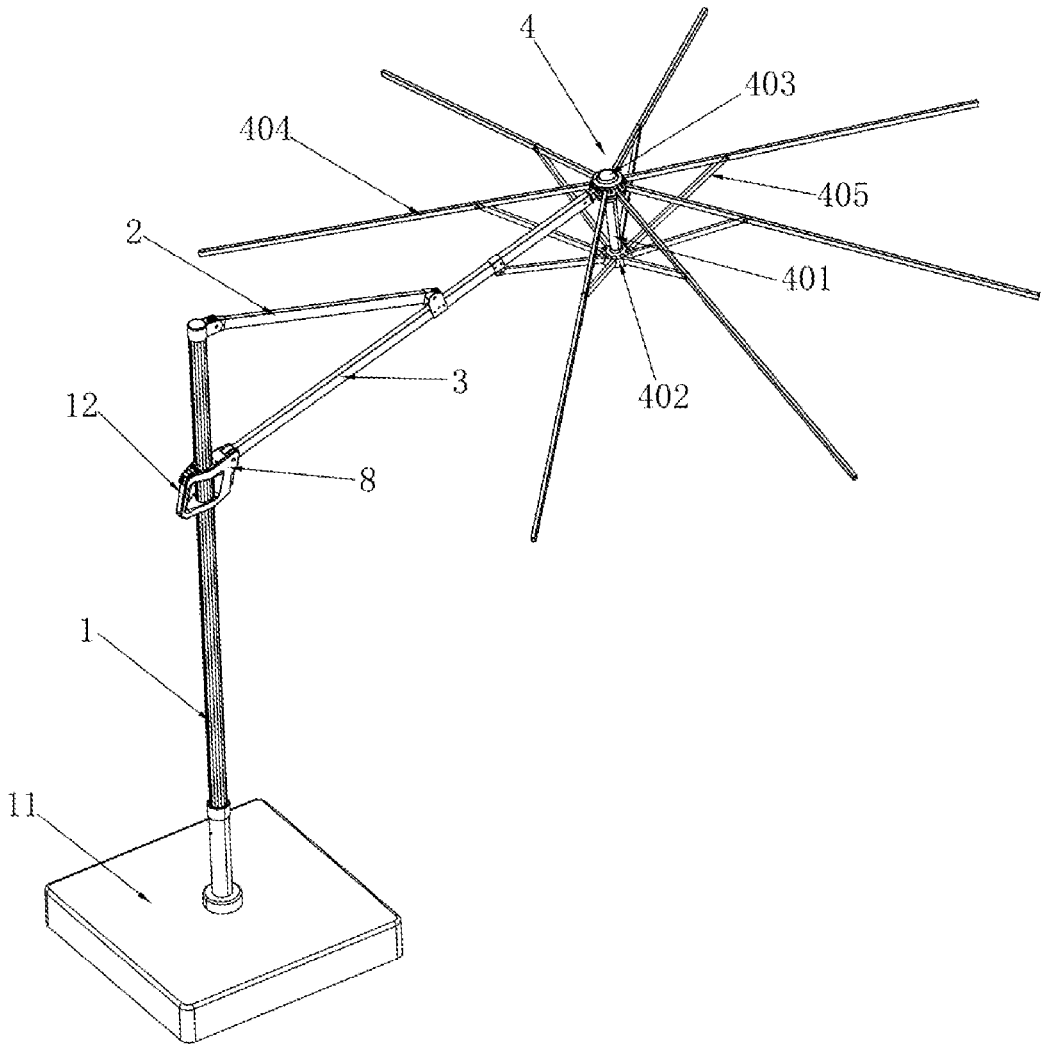
FIG. 1 is a perspective view of a conveniently open and close sun umbrella according to the present invention.

The corresponding reference numeral parts in the accompanied figures are: 1. Vertical pole; 2. Connecting rod; 3. Inclined rod; 4. Umbrella frame; 5. First pull rope; 6. Movable pulley; 7. Second pull rope; 8. Slide locking piece; 9. First pulley; 10. Second pulley; 11. Base; 12. Handle; 81. Sliding seat; 83. Second locking rod; 84. First press block; 85. Second press block; 101. First locking grooves; 102. Second locking grooves; 401. Central rod; 402. Movable umbrella disk; 403. Fixed umbrella disk; 404. Ribs; 405. Bracing ribs; 821. Locking base; 822. First locking rod; 823. Limit chuck; 824. First locking head; 831. Second locking head.

DETAILED IMPLEMENTATION METHOD

The specific implementation method of the present invention will be described in further detail below in conjunction with the accompanied figures and embodiments. The following embodiments are used to illustrate the present invention, but not to limit the scope of the present invention.

Figure 2:
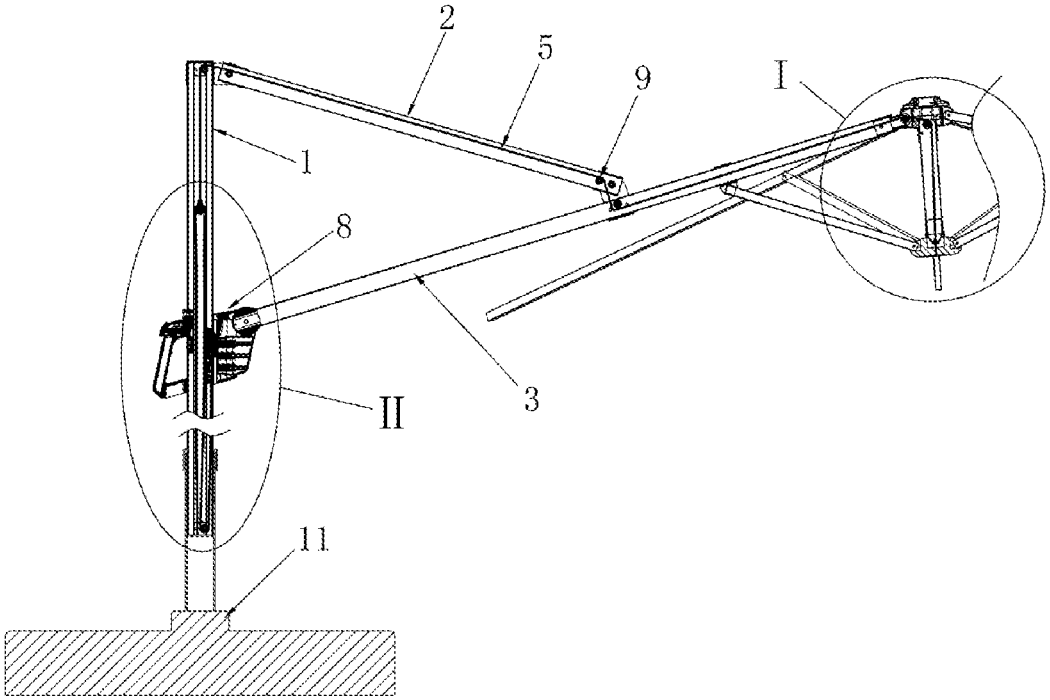
FIG. 2 is a schematic structural view of a conveniently open and close sun umbrella according to the present invention.
Figure 3:
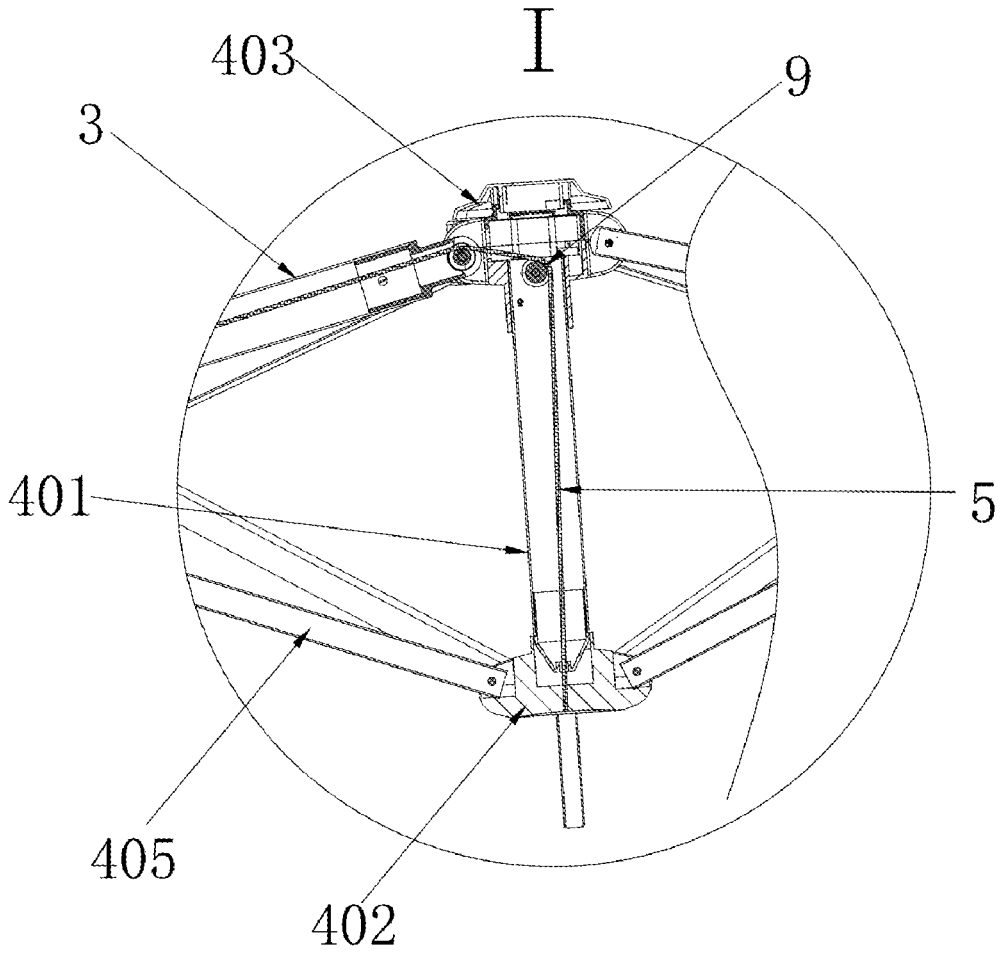
FIG. 3 is an enlarged view of part I of FIG. 2.
Figure 4:
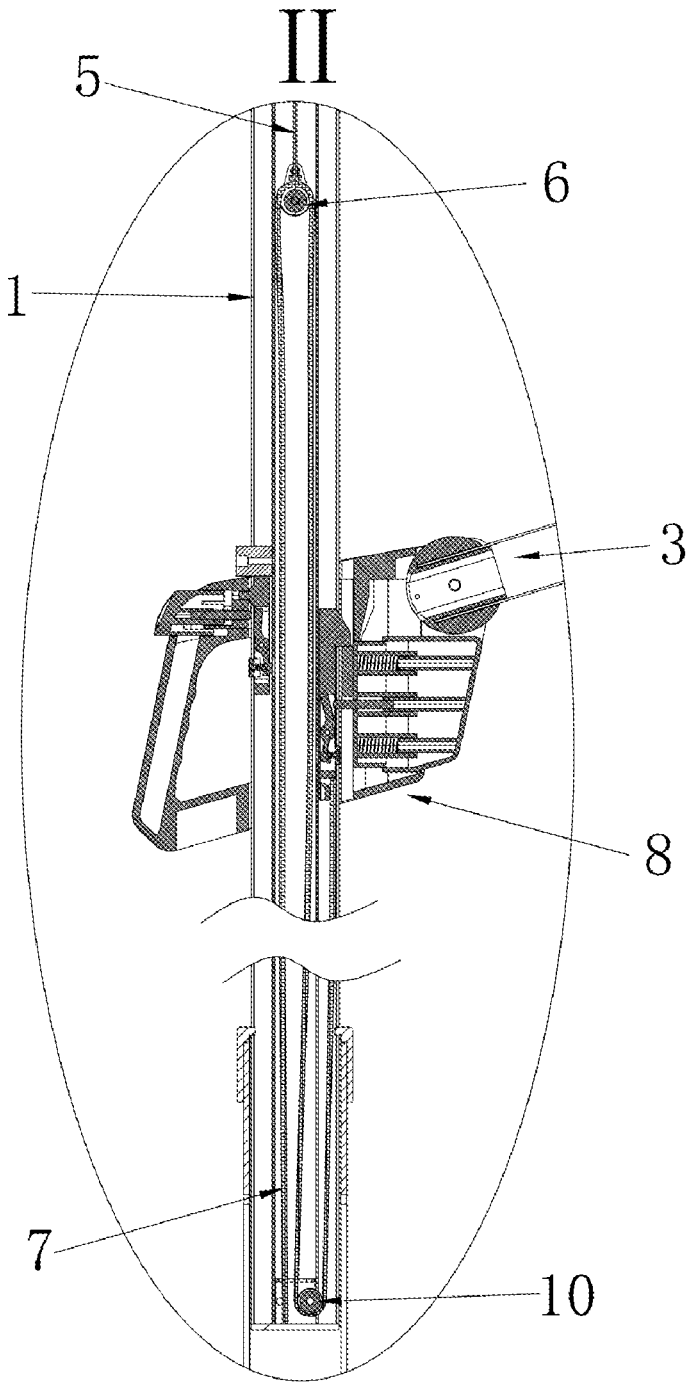
FIG. 4 is an enlarged view of part II of FIG. 2.
Figure 5:
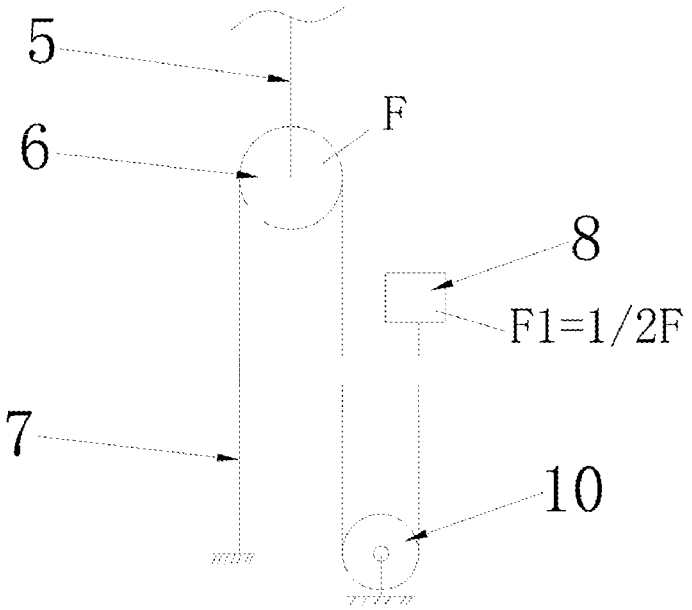
FIG. 5 is a schematic structural view of the opening mechanism of a conveniently open and close sun umbrella according to the present invention.
Figure 6:
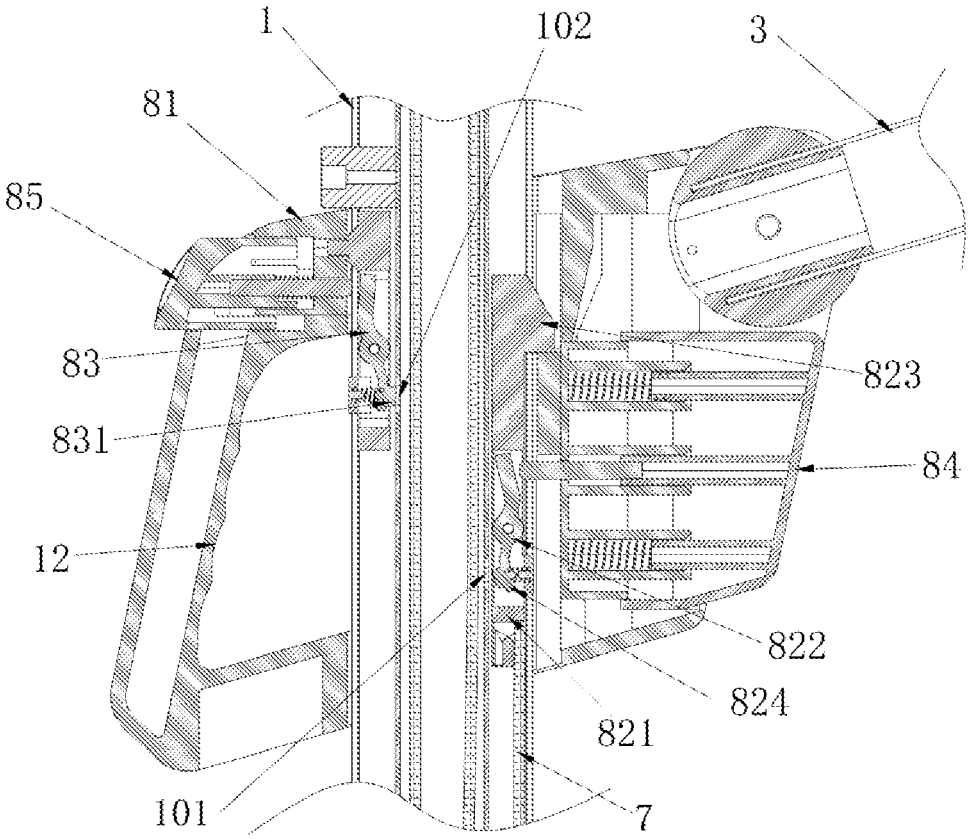
FIG. 6 is a schematic structural view of the slide locking piece of a conveniently open and close sun umbrella according to the present invention.
Figure 7:
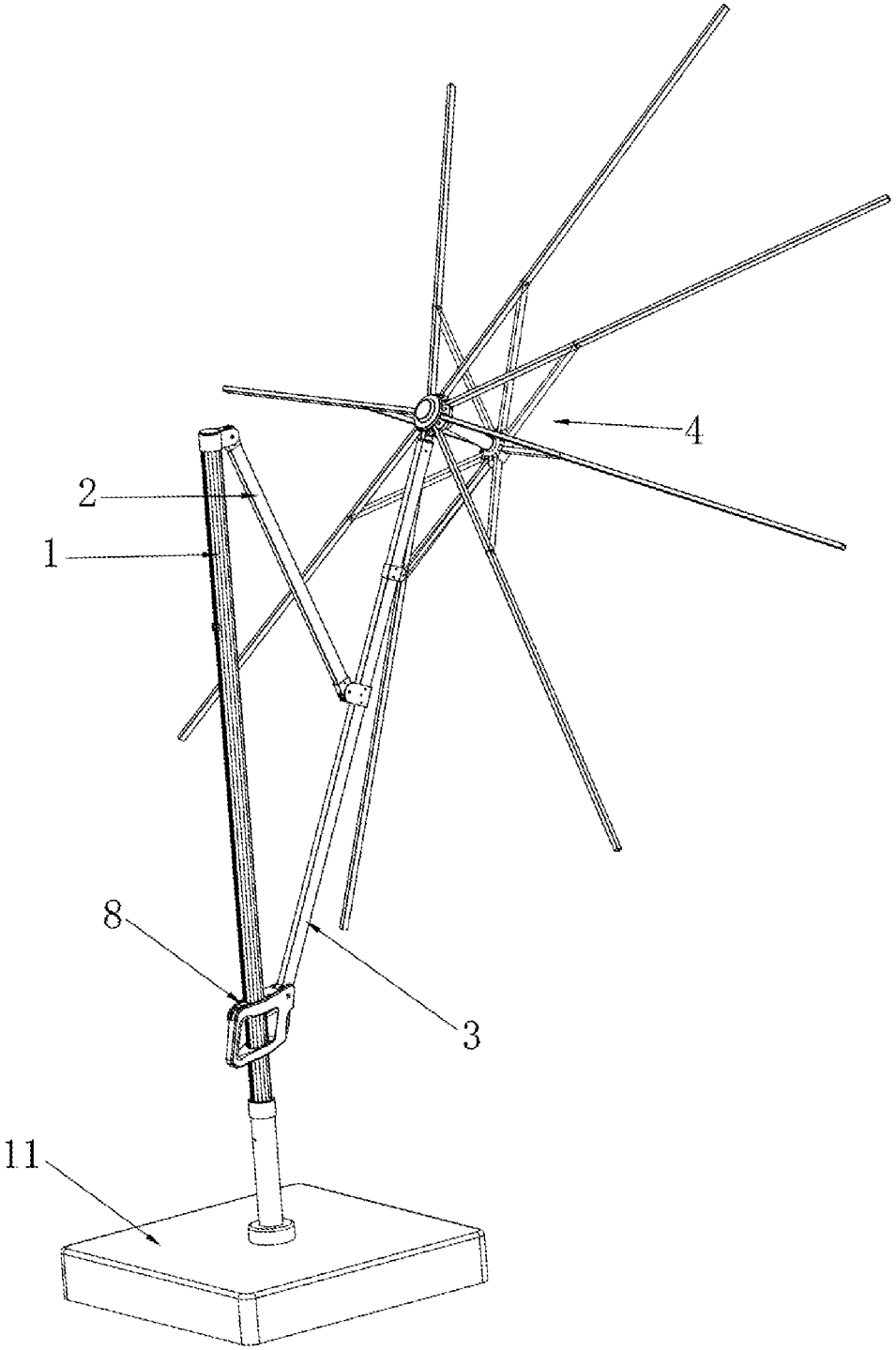
FIG. 7 is a perspective view of the umbrella frame of a conveniently open and close sun umbrella according to the present invention after adjusting the angle.

Refer to FIG. 1 to FIG. 7, the present invention provides a conveniently open and close sun umbrella, which comprises a vertical pole 1, a connecting rod 2, an inclined rod 3, an umbrella frame 4 and an umbrella opening mechanism, whereby one end of the connecting rod 2 is hinged to the upper end of the vertical pole 1, and the other end is hinged to the middle of the inclined rod 3. A base 11 is fixed at the bottom of the vertical pole 1, and the base 11 is placed on the ground. The umbrella frame 4 includes a central rod 401, a movable umbrella disk 402, a fixed umbrella disk 403, multiple ribs 404 and multiple bracing ribs 405, wherein the end of each rib 404 is hinged on the fixed umbrella disk 403. The central rod 401 is fixed on the fixed umbrella disk 403. One end of each bracing rib 405 corresponding to the inclined rod 3 can be slidably mounted on the inclined rod 3, and the other end is hinged on the movable umbrella disk 402. Both ends of the remaining bracing ribs 405 are respectively hinged on the middle of the corresponding ribs 404 and the movable umbrella disk 402.

The umbrella opening mechanism includes a first pull rope 5, a movable pulley 6, a second pull rope 7 and a slide locking piece 8, wherein the slide locking piece 8 is slidably mounted on the vertical pole 1. One end of the inclined rod 3 is hinged on the slide locking piece 8, and the other end is hinged on the fixed umbrella disk 403. One end of the first pull rope 5 is fixed on the movable pulley 6, while the movable pulley 6 is placed in the vertical pole 1, and the other end passes through the connecting rod 2, the inclined rod 3 and the central rod 401 successively and is fixed on the movable umbrella disk 402. The central rod 401, the inclined rod 3, the connecting rod 2 and the vertical pole 1 are respectively rotatably installed with one or more first pulleys 9 to facilitate pulling of the first pull rope 5. One end of the second pull rope 7 is fixed at the lower end of the vertical pole 1, and the other end goes around the movable pulley 6 and is fixed on the slide locking piece 8. The lower end of the vertical pole 1 is rotatably installed with a second pulley 10 to facilitate pulling of the second pull rope 7. With this umbrella opening mechanism, by sliding the slide locking piece 8, the umbrella frame 4 can be automatically opened or closed. The operation process is simple and convenient. Moreover, the first pull rope is switched to the second pull rope through the movable pulley, and the pulling force is reduced by half. The opening and closing saves time and effort, and possess good practicality.

The slide locking piece 8 is provided with a handle 12 which facilitates sliding of the slide locking piece 8. The slide locking piece 8 includes a locking mechanism, a sliding seat 81 and a second locking rod 83. The sliding seat 81 and the locking mechanism are respectively slidably mounted on the vertical pole 1. The vertical pole 1 is provided with corresponding sliding grooves. The locking mechanism includes a locking seat 821 and a first locking rod 822 hinged on the locking base 821. The end of the second pull rope 7 is fixed on the locking base 821, the locking base 821 is snap fastened on the sliding seat 81 by a limit chuck 823. One end of the first locking rod 822 is provided with a first locking head 824, and a first locking groove 101 matching with the first locking head 824 is provided on the vertical pole 1. The second locking rod 83 is hinged on the sliding seat 81. One end of the second locking rod 83 is provided with a second locking head 831, and a plurality of second locking grooves 102 matching with the second locking head 831 are provided at equal intervals along a vertical direction on the vertical pole 1. Wherein, the first locking rod 822 and the second locking rod 83 are having the same structure. The sliding seat 81 is slidably installed with a first press block 84 at a position corresponding to the first locking rod 822, and slidably installed with a second press block 85 at a position corresponding to the second locking rod 83. Pressing the first press block 84 can drive the first locking rod 822 to rotate, and pressing the second press block 85 can drive the second locking rod 83 to rotate. A locking mechanism and a second locking rod are arranged in the slide locking piece. When the locking mechanism is locked, the second pull rope is fixed on the vertical pole, the umbrella frame is fully extended, and the sliding seat can be slid down by pressing the second locking rod, thereby causing the sliding seat to drive the inclined rod and change the angle of the umbrella frame, and the angle of the umbrella can be adjusted according to actual use requirements, making the application more flexible.

When opening, pressing the second press block 85 and slides up the sliding seat 81. The sliding seat 81 drives the locking seat 821 to slide upward together, the locking seat 821 pulls the second pull rope 7, and the second pull rope 7 drives the movable pulley 6 to slide down, and the movable pulley 6 pulls down the first pull rope 5. The first pull rope 5 pulls the movable umbrella disk 402, causing the movable umbrella disk 402 to abut against the lower end of the central rod 401. When the first locking rod 822 is locked in the first locking groove 101, the umbrella frame 4 is fully extended. Meantime the second locking rod 83 is locked in the uppermost second locking groove 102. When adjusting the angle, pressing the second press block 85, and the second locking rod 83 is separated from the uppermost second locking groove 102. Slides down the sliding seat 81, and the sliding seat 81 is separated from the locking mechanism. The sliding seat 81 drives the inclined rod 3 to change the angle of umbrella frame 4. Slides the sliding seat 81 to a proper position, so that the second locking rod 83 is locked in the corresponding second locking groove 102. When closing, pressing the second press block 85 and the first press block 84 and slides the sliding seat 81 downward. The umbrella frame 4 can be automatically closed. This structure provides simple and convenient operation. The opening and closing are convenient, time-saving and labor-saving, with good practicability.

The embodiments provide a conveniently open and close sun umbrella. Through the cooperation of the first pull rope, the movable pulley, the second pull rope and the slide locking piece, the umbrella frame can be opened by sliding the slide locking piece upward during application, causing the second pull rope to drive the movable pulley sliding down, and the first pull rope drives the movable umbrella disk to abut against the lower end of the central rod, thereby propping up the umbrella frame. The operation process is simple and convenient, and the opening and closing is convenient. In addition, the first pull rope is switched to the second pull rope through the movable pulley. The pulling force is reduced by half, which saves effort to open, and has good practicability. Moreover, a locking mechanism and a second locking rod are arranged in the slide locking piece. When the locking mechanism is locked, the second pull rope is fixed on the vertical pole, the umbrella frame is fully extended, and the sliding seat can be slid down by pressing the second locking rod, thereby causing the sliding seat to drive the inclined rod and change the angle of the umbrella frame, and the angle of the umbrella can be adjusted according to actual use requirements, making the application more flexible. It overcomes the shortcoming of inconvenience in opening and closing of the existing sunshades.

The above are only the preferred embodiments of the present invention. It should be pointed out that for those of ordinary skill in the art, several improvements and modifications can be made without departing from the technical principles of the present invention, and these improvements and modifications should also be regarded as the protection scope of the present invention.

What is claimed is:

1. A conveniently open and close sun umbrella, comprising a vertical pole, a connecting rod, an inclined rod, an umbrella frame and an umbrella opening mechanism, whereby two ends of the connecting rod are respectively hinged on the vertical pole and the inclined rod; the umbrella opening mechanism includes a first pull rope, a movable pulley, a second pull rope and a slide locking piece, wherein the slide locking piece is slidably mounted on the vertical pole, the umbrella frame includes a central rod, a movable umbrella disk and a fixed umbrella disk fixed to the central rod; one end of the inclined rod is hinged on the slide locking piece, and the other end is hinged on the fixed umbrella disk; one end of the first pull rope is fixed on the movable pulley, and the other end passes through the connecting rod, the inclined rod and the central rod successively and is fixed on the movable umbrella disk; one end of the second pull rope is fixed on the vertical pole, and the other end goes around the movable pulley and is fixed on the slide locking piece; the umbrella is opened by sliding the slide locking piece upward, which drives the movable pulley to slide down, causes the movable umbrella disk to abut against the lower end of the central rod, thereby opens the umbrella frame.

2. A conveniently open and close sun umbrella of claim 1, wherein the umbrella frame further includes multiple ribs and multiple bracing ribs, wherein the end of each rib is hinged on the fixed umbrella disk; one end of each bracing rib corresponding to the inclined rod can be slidably mounted on the inclined rod, and the other end is hinged on the movable umbrella disk; both ends of the remaining bracing ribs are respectively hinged on the middle of the corresponding ribs and the movable umbrella disk.

3. A conveniently open and close sun umbrella of claim 1, wherein the central rod, the inclined rod, the connecting rod and the vertical pole are respectively rotatably installed with one or more first pulleys to facilitate pulling of the first pull rope; and the lower end of the vertical pole is rotatably installed with a second pulley to facilitate pulling of the second pull rope.

4. A conveniently open and close sun umbrella of claim 1, wherein a base is fixed at the bottom of the vertical pole, and the base is placed on the ground.

5. A conveniently open and close sun umbrella of claim 1, wherein one end of the connecting rod is hinged to the upper end of the vertical pole, and the other end is hinged to the middle of the inclined rod.

6. A conveniently open and close sun umbrella of claim 1, wherein the slide locking piece is provided with a handle which facilitates sliding of the slide locking piece.

7. A conveniently open and close sun umbrella of claim 1, wherein the slide locking piece includes a locking mechanism and a sliding seat, wherein the sliding seat and the locking mechanism are respectively slidably mounted on the vertical pole; the locking mechanism includes a locking seat and a first locking rod hinged on the locking base, the end of the second pull rope is fixed on the locking base, the locking base is snap fastened on the sliding seat by a limit chuck; one end of the first locking rod is provided with a first locking head, and a first locking groove matching with the first locking head is provided on the vertical pole.

8. A conveniently open and close sun umbrella of claim 7, wherein the slide locking piece further includes a second locking rod wherein the second locking rod is hinged on the sliding seat; one end of the second locking rod is provided with a second locking head, and a plurality of second locking grooves matching with the second locking head are provided at equal intervals along a vertical direction on the vertical pole.

9. A conveniently open and close sun umbrella of claim 8, wherein the sliding seat is slidably installed with a first press block at a position corresponding to the first locking rod and slidably installed with a second press block at a position corresponding to the second locking rod.

10. A conveniently open and close sun umbrella of claim 8, wherein the first locking rod and the second locking rod are having the same structure.

* * * * *